US007805771B2

(12) United States Patent
Ekelund et al.

(10) Patent No.: US 7,805,771 B2
(45) **Date of Patent: *Oct. 5, 2010**

(54) NURSING COVER

(75) Inventors: Ronnie Michael Ekelund, Monte Sereno, CA (US); Claire Rachael Jane Ekelund, Monte Sereno, CA (US)

(73) Assignee: Bebe au Lait LLC, Los Gatos, CA (US)

( * ) Notice: Subject to any disclaimer, the term of this patent is extended or adjusted under 35 U.S.C. 154(b) by 108 days.

This patent is subject to a terminal disclaimer.

(21) Appl. No.: 12/143,140

(22) Filed: Jun. 20, 2008

(65) Prior Publication Data

US 2008/0250542 A1 Oct. 16, 2008

Related U.S. Application Data

(63) Continuation of application No. 11/507,891, filed on Aug. 21, 2006, now Pat. No. 7,406,718, which is a continuation-in-part of application No. 11/497,109, filed on Jul. 31, 2006, now Pat. No. 7,409,727.

(51) Int. Cl.
*A41D 1/20* (2006.01)
*A41D 1/27* (2006.01)

(52) U.S. Cl. ..... 2/104; 2/46

(58) Field of Classification Search ..... 2/46, 2/48, 49.1–49.4, 88, 69, 51, 50, 52, 104, 2/105, 106, 113–115, 338, 336, 255–261
See application file for complete search history.

(56) References Cited

U.S. PATENT DOCUMENTS 88,752 A 4/1869 Strauss (Continued)

FOREIGN PATENT DOCUMENTS

DE M9802615-0001 11/1998

(Continued)

OTHER PUBLICATIONS

Copenheaver, Blaine R., Notification of Transmittal of the International Search Report and the Written Opinion of the International Searching Authority, or the Declaration, Patent Cooperation Treaty, Jan. 18, 2008, International application No. PCT/US07/17041.

(Continued)

*Primary Examiner*—Gloria Hale
(74) *Attorney, Agent, or Firm*—Kokka & Backus, PC

(57) ABSTRACT

A nursing cover including a sheet, where a stiffener pocket, a first strap and a second strap are disposed along a top edge of the sheet, the first strap and the second strap being configured to detachably couple together, and a stiffener housed within the stiffener pocket, configured to bow outward from the top edge of the sheet. The stiffener having a shape memory material having a material memory associated with a pre-determined shape and assuming the pre-determined shape during a resting state. When a force is applied, the stiffener is configured to temporarily deform and when the force is removed, the stiffener reassumes the pre-determined shape. The stiffener has a first end cap formed at a first end and a second end cap formed at a second end, where the stiffener, the first end cap and the second end cap are collectively a single member.

17 Claims, 5 Drawing Sheets

U.S. PATENT DOCUMENTS

| | | | | |
|---|---|---|---|---|
| 496,313 | A | 4/1893 | Janowitz | |
| 559,683 | A | 5/1896 | Crotty | |
| 905,420 | A | 12/1908 | Hagen | |
| 1,276,700 | A | 8/1918 | Kleemann | |
| 1,297,742 | A | 3/1919 | Shorrock | |
| 1,503,128 | A | 7/1924 | Leland et al. | |
| 2,244,167 | A | 6/1941 | McGee | |
| 3,037,211 | A | 6/1962 | Bohm | |
| 3,126,007 | A | 3/1964 | Jonas | |
| 3,209,756 | A | 10/1965 | Rowell | |
| 3,599,643 | A | 8/1971 | Schwartz | |
| 3,605,753 | A | 9/1971 | Schwartz | |
| 3,799,175 | A | 3/1974 | Rowell | |
| 4,271,580 | A | 6/1981 | King et al. | |
| 4,903,349 | A | 2/1990 | Arai | |
| 4,989,268 | A | 2/1991 | Stolhand | |
| 5,444,896 | A * | 8/1995 | Bourget | 24/265 A |
| 5,469,582 | A | 11/1995 | Livingston | |
| 5,479,662 | A | 1/1996 | Runco | |
| 5,652,958 | A | 8/1997 | Farrell-Mestas | |
| 5,665,057 | A | 9/1997 | Murphy | |
| 5,893,171 | A | 4/1999 | Ries | |
| 5,934,970 | A | 8/1999 | Morgan et al. | |
| 5,956,762 | A | 9/1999 | Adams | |
| 6,836,900 | B1 | 1/2005 | Fus, Sr. | |
| 7,112,117 | B2 | 9/2006 | Horta et al. | |
| 7,406,718 | B2 * | 8/2008 | Ekelund et al. | 2/104 |
| 7,409,727 | B2 * | 8/2008 | Ekelund et al. | 2/104 |

FOREIGN PATENT DOCUMENTS

| | | | |
|---|---|---|---|
| JP | 1171412 | S | 4/2003 |
| JP | 1228490 | S | 1/2005 |

OTHER PUBLICATIONS

Copenheaver, Blaine R., Notification of Transmittal of the International Search Report and the Written Opinion of the International Searching Authority, or the Declaration, Patent Cooperation Treaty, May 16, 2007, International application No. PCT/US06/39062.

* cited by examiner

NURSING COVER

CROSS REFERENCE TO RELATED APPLICATIONS

This application is a continuation of U.S. patent application Ser. No. 11/507,891 filed Aug. 21, 2006 entitled "Nursing Cover," which is a continuation-in-part of U.S. patent application Ser. No. 11/497,109 filed Jul. 31, 2006 entitled "Nursing Cover," which are both incorporated herein by reference for all purposes. This application is also related to application Ser. No. 12/143,110 entitled "Nursing Cover".

FIELD OF THE INVENTION

The present invention relates to clothing and, more specifically, to a nursing cover.

BACKGROUND

Newborn babies are often breastfed by mothers, which can be an intimate and personal bonding experience between mothers and their babies. When breastfeeding, a mother typically exposes the upper portions of her torso, which may make her uncomfortable if located in a public or highly trafficked area. Conventional solutions for covering exposed areas (e.g., upper torso, breasts, and the like) of a nursing mother have several limitations and are often bulky, uncomfortable, unsafe, or difficult to handle.

In some conventional solutions, large towels or small sheets are used, which are bulky and typically made of heavy, non-breathable material. These types of materials are often too warm to wear, increasing the body temperature of the mother and the baby, resulting in difficult or uncomfortable breastfeeding. Further, heavy, bulky, or non-breathable materials may also pose a risk of asphyxiation or cause overheating with a nursing baby.

Conventional nursing covers are also problematic because they are difficult to wear or secure when worn. Draping or placing a cover, wrap, or sheet over a mother's shoulder to cover the nursing newborn often blocks visibility of the baby. Further, baby movement may cause the cover, wrap, or sheet to slip in position or completely fall off. With conventional techniques, visibility between a mother and her newborn are obscured, preventing the former from observing or monitoring the latter during breastfeeding. Positioning, latching, and other factors can be inhibited or detrimentally affected by conventional covers, wraps, and sheets. Further, mothers are physically restricted in their ability to manage these factors while securing and maintaining a conventional cover, wrap, or sheet in place.

Thus, what is required is a solution for covering a baby while nursing without the limitations of conventional techniques.

BRIEF DESCRIPTION OF THE DRAWINGS

The present invention will be readily understood by the following detailed description in conjunction with the accompanying drawings, and like reference numerals designate like structural elements.

DETAILED DESCRIPTION

Embodiments or examples of the invention may be implemented in numerous ways, including as an apparatus, system, or process. A detailed description of one or more examples is provided below along with accompanying figures. The detailed description is provided in connection with such examples, but is not limited to any particular example. The scope is limited by the claims, but numerous alternatives, modifications, and equivalents are encompassed. Numerous specific details are set forth in the following description in order to provide a thorough understanding. These details are provided for the purpose of example and the descriptions provided may be used for implementation according to the claims without some or all of these specific details. For the purpose of clarity, technical material that is known in the technical fields related to the examples has not been described in detail to avoid unnecessarily obscuring the description.

A nursing cover is described, including a cover, wrap, fabric, or sheet ("sheet") having a stiffener sewn or stitched ("stitched") into an edge, which allows positional securing without inhibiting visibility. Further, end caps provided at each end of the stiffener provides reinforced protection to avoid abrasion between the stiffener and a stitched pocket in which the stiffener is placed. When worn, a nursing cover covers a breastfeeding baby, a mother's exposed torso, while providing a window for the mother to observe or monitor the baby. A nursing cover, as described in greater detail below, may also protect a baby from other environment factors such as sun, wind, rain, and the like. In some examples, a nursing cover as described below may be used to shield a baby who is not nursing, but instead being carried in a sling or cradle such as a Baby Bjorn® or the like. In other words, a nursing cover as described in the various examples below, may be used to protect a mother and her child from various types of natural and man-made environmental factors and conditions. Various alternative implementations and modifications to the examples provided may be used and are not limited to the descriptions, dimensions, or other exemplary details provided herein.

Figure 1:
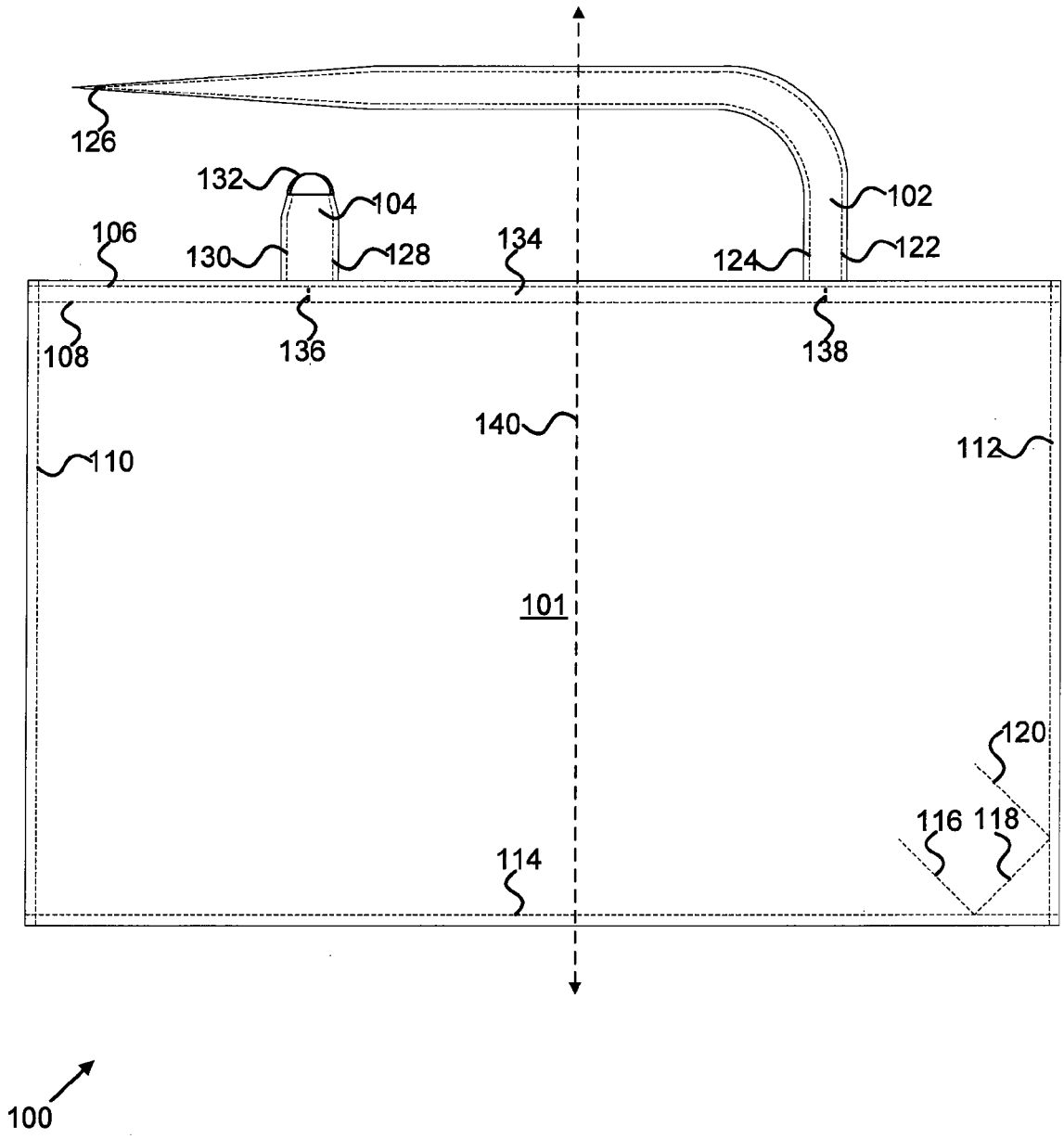
FIG. 1 illustrates a front view of an exemplary nursing cover.

FIG. 1 illustrates a front view of an exemplary nursing cover. Here, nursing cover 100 includes sheet 101, strap 102, D-ring strap 104, upper top edge stitch 106, lower top edge stitch 108, left edge stitch 110, right edge stitch 112, bottom edge stitch 114, and pocket stitches 116-120. Strap 102 further includes side stitches 122-124 and tapered edge 126. D-ring strap 104 also includes side stitches 128-130 and one or more D-rings 132. In some examples, D-ring strap 104 may be implemented with one or more D-rings 132, which are used to secure strap 102. Strap 102 may be secured by tying, slipping, knotting, or otherwise coupling, directly or indirectly, to D-ring strap 104. In other examples, D-ring strap 104 may be implemented with other types of securing rings or brackets, including O-rings, H-brackets, and the like. Nursing cover 100 also includes stiffener pocket 134 and pocket stitches 136-138. Pocket 134 may be used to hold a stiffener, which is described in greater detail below in connection with FIGS. 4A-4C.

Referring back to FIG. 1, a stiffener may be a length of material that, when placed within stiffener pocket 134, extends outward from the wearer of nursing cover 100. A stiffener may be a flexible, but semi-rigid strip or length of material that "bows outwards" from a top edge of sheet 101. When bowed, the stiffener holds the top edge of sheet 101 away from the wearer, thus providing an opening or aperture for maintaining visibility between the wearer and a baby underneath. Stiffeners may be made of natural or synthetic materials, including wood, plastic, nylon, metal, composite, or others. Further, a stiffener may be formed with a radius of curvature that allows a top edge of sheet 101 to extend away from the plane of sheet 101 when secured in a resting position. In other words, a stiffener may have a material memory (e.g., made of a shape memory material) that provides a curving shape that persists without requiring the exertion of force or pressure to achieve the curvature.

In some examples, sheet 101 may be implemented using any type of fabric made from natural or synthetic fibers, including cotton, wool, silk, denim, polyester, nylon, and various types of blends. Further, various types of designs may be placed on sheet 101 using any type of technique such as silk-screening, embroidery, or forming patterns or designs within the weave of the fabric. Other types of fabrics and designs may be used and nursing cover 100 is not limited to the examples provided. Regardless of the type of material used for sheet 101, nursing cover 100 may be placed to cover the upper torso of a nursing mother to provide an intimate and non-observable nursing experience for the baby and the mother. Further, a stiffener placed within stiffener pocket 134 and bounded by pocket stitches 136-138 may be used to provide a full or partially hemispherical support that projects outward from nursing cover 100 on a plane that is substantially orthogonal to vertical axis 140. In other words, if nursing cover 100 is worn in an upright position by a mother, a stiffener (not shown) in stiffener pocket 134 may extend a center portion of the top edge outwards and away from the mother. The mother's upper torso remains covered, a nursing baby is shielded from external view, and sheet 101 provides non-transparent protection from unwanted viewing while nursing. Nursing cover 100 may be implemented differently than described above and is not limited to the examples provided.

Figure 2A:
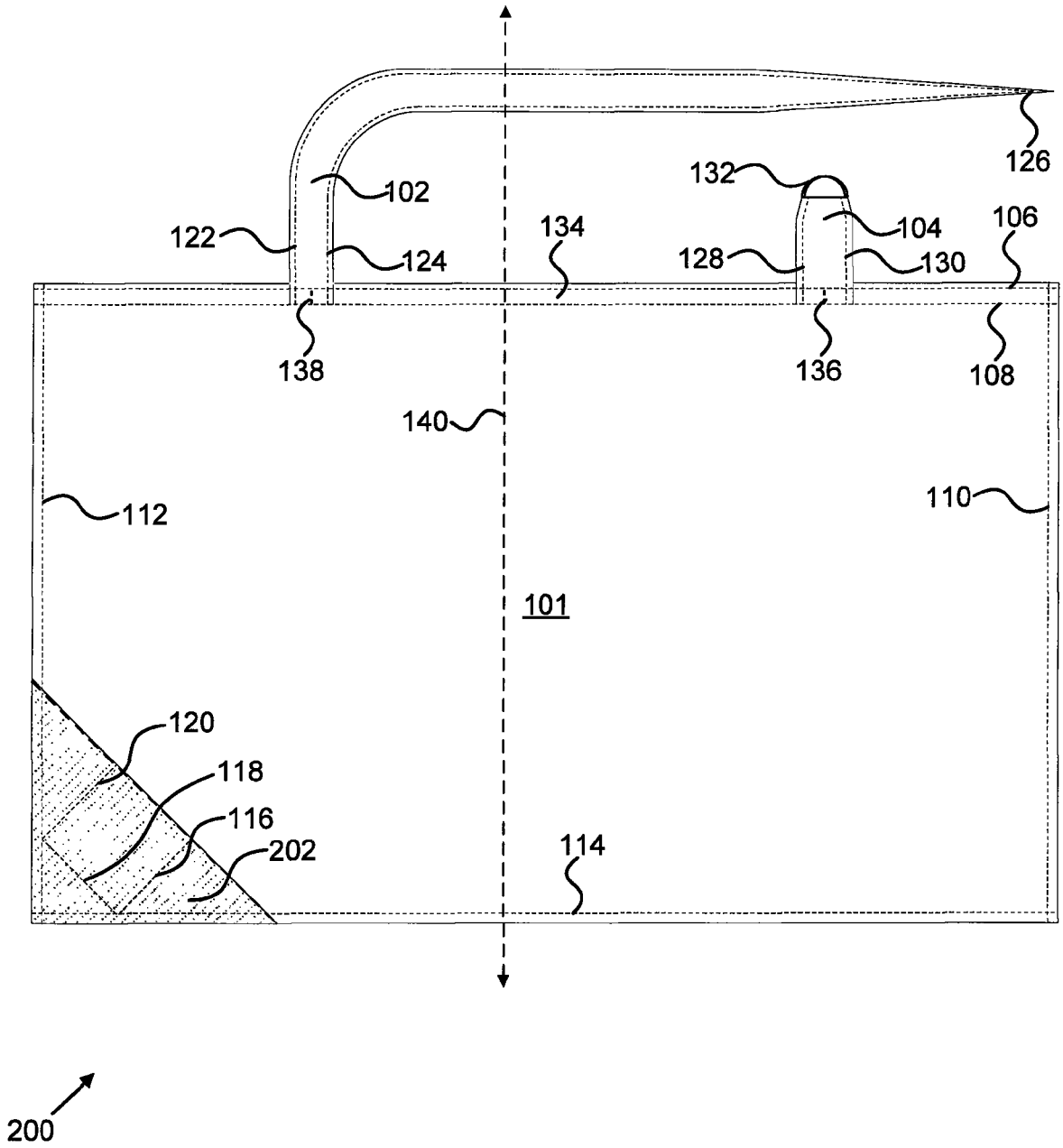
FIG. 2A illustrates a rear view of an exemplary nursing cover.

FIG. 2A illustrates a rear view of an exemplary nursing cover. Here, nursing cover 200 also includes sheet 101, strap 102, D-ring strap 104, upper top edge stitch 106, lower top edge stitch 108, left edge stitch 110, right edge stitch 112, bottom edge stitch 114, and pocket stitches 116-120. Strap 102 further includes side stitches 122-124 and tapered edge 126. D-ring strap 104 also includes side stitches 128-130 and one or more D-rings 132. Stiffener pocket 134 is also provided, being bounded by pocket stitches 136-138 and upper top edge stitch 106 and lower top edge stitch 108. A pocket may be provided by using pocket fabric 202, which may be stitched into a corner of sheet 101. Pocket fabric 202 may be stitched into place by right edge stitch 112 and bottom edge stitch 114. A diagonal edge of pocket fabric 202 extending from right edge stitch 112 to bottom edge stitch 114 may also be stitched, but with an unstitched portion left open between pocket stitch 116 and 120, thus creating a pocket for the wearer to retrieve and store items. Pocket stitches 116-120 provide edges for a pocket, which may be used to hold various items for a nursing mother, including a bottle, burp cloth, wipes, pacifier, baby clothing, nursing implements, and the like. Further, the placement of a pocket bounded by pocket stitches 116-120 using pocket fabric 202 on the rear or "inside" surface of nursing cover 200 allows a nursing mother to retrieve or store items such as those described above. In other embodiments, pocket fabric 202 may be implemented differently and is not limited to the example shown.

Figure 2B:
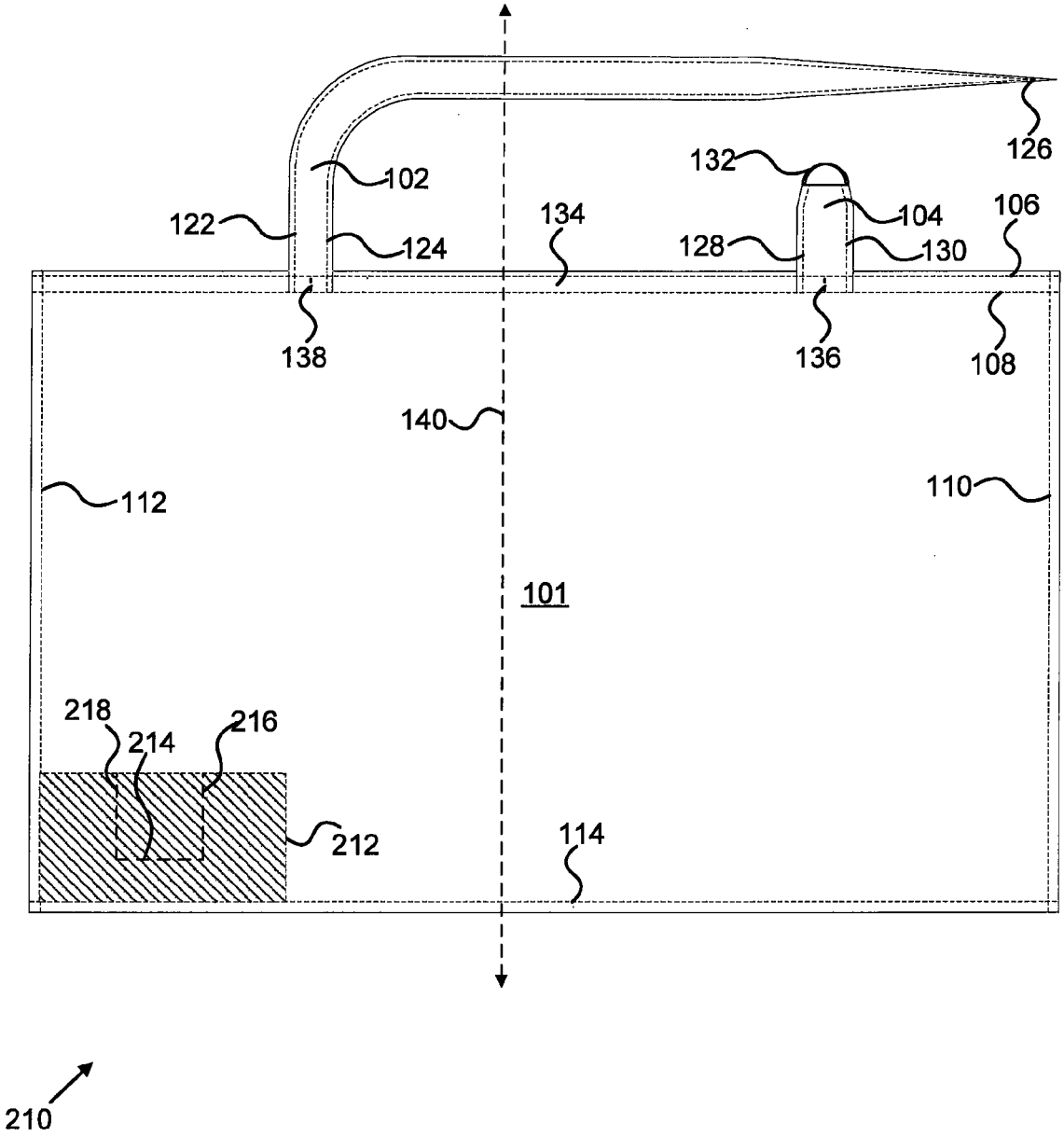
FIG. 2B illustrates a rear view of an alternative exemplary nursing cover.

FIG. 2B illustrates a rear view of an alternative exemplary nursing cover. Here, nursing cover 210 is shown, also including sheet 101, strap 102, D-ring strap 104, upper top edge stitch 106, lower top edge stitch 108, left edge stitch 110, right edge stitch 112, bottom edge stitch 114, and pocket stitches 116-120. Strap 102 further includes side stitches 122-124 and tapered edge 126. D-ring strap 104 also includes side stitches 128-130 and one or more D-rings 132. Stiffener pocket 134 is also provided, being bounded by pocket stitches 136-138 and upper top edge stitch 106 and lower top edge stitch 108. Alternatively, pocket fabric 212 and pocket stitches 214-218 are shown, which provide a different-type of pocket from that shown and described above in connection with FIG. 2A. In some examples, pocket fabric 212 may be formed using the same or a different type of material as sheet 101. For example, terry cloth material may be used for pocket fabric 212, which provides a soft material that minimize abrasion with exposed skin of a wearer (i.e., a nursing mother). In other examples, different types of materials may be used for pocket fabric 212 to form a pocket. Further, pocket fabric 212 may be located in a different area or on the outside of sheet 101. For example, pocket fabric 212 may be located in the inside of sheet 101, but on a different corner to accommodate left or right-handed mothers. Further, different sizes of pocket fabrics 212 may be stitched into sheet 101, providing smaller or larger sized pockets for holding items of various sizes. In some examples, pocket fabric 212 may be configured to provide a secure pocket, closed using a clasp or other item that allows the wearer to place items in a secure location while nursing.

Here, pocket 212 provides a pocket with an opening that is horizontally configured, lying in a plane that is orthogonal to vertical axis 140. Bounded by pocket stitches 214-218 and left open across the top edge of pocket fabric 212, a pocket is formed that allows the wearer to store and retrieve items such as those described above in connection with FIG. 2A. In other examples, different types of pockets may be implemented and are not limited to the examples shown and described. Numerous other shapes, sizes, fabric types, and locations may be used with pocket fabric 212 and nursing cover 210 is not limited to the pocket examples shown and provided above. Further, nursing cover 210 and the elements described may be varied and are not limited to the examples provided above.

Figure 3:
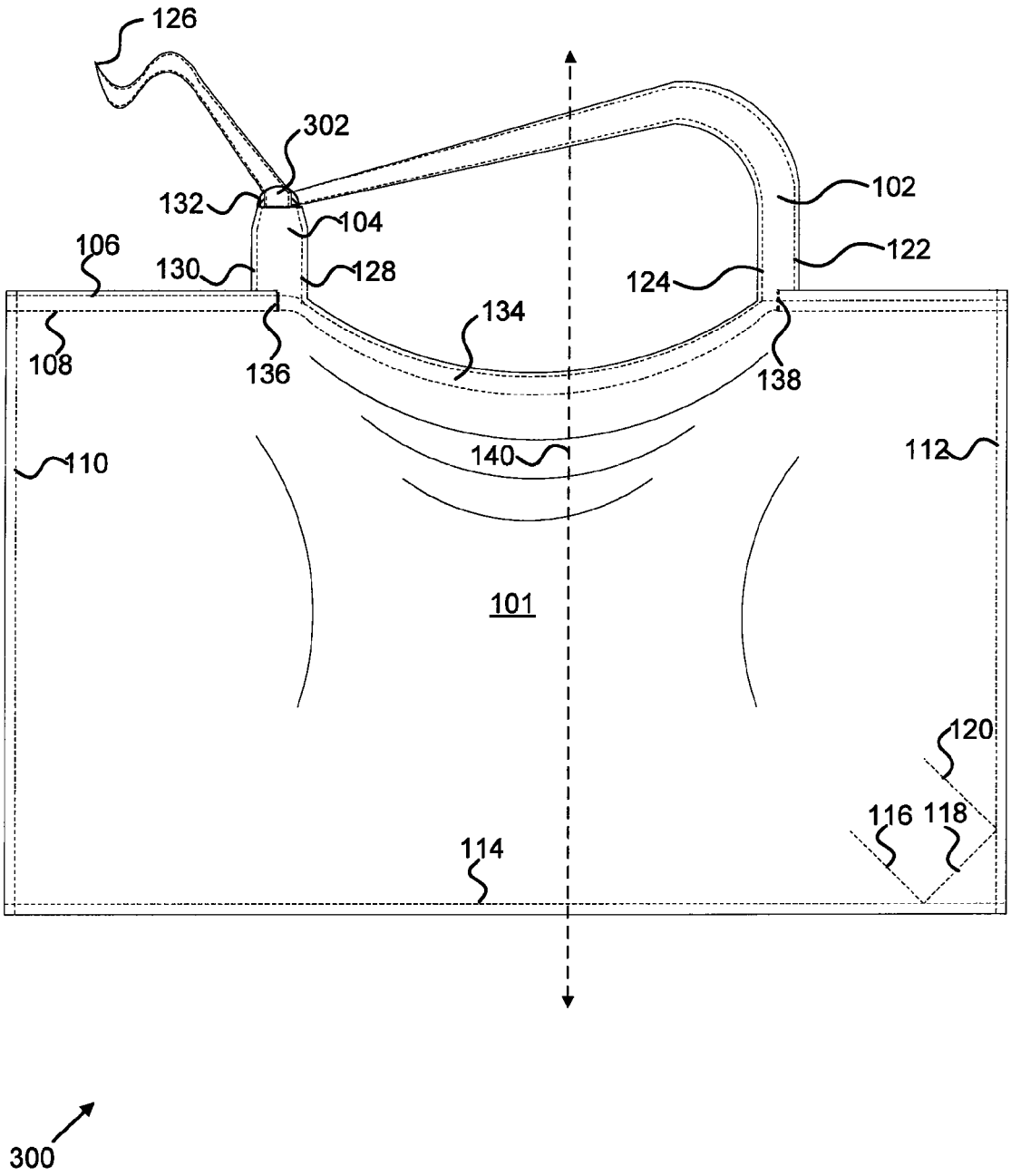
FIG. 3 illustrates an alternative frontal view of an exemplary nursing cover when worn.

FIG. 3 illustrates an alternative frontal view of an exemplary nursing cover when worn. Here, nursing cover 300 is shown, including sheet 101, strap 102, D-ring strap 104, upper top edge stitch 106, lower top edge stitch 108, left edge stitch 110, right edge stitch 112, bottom edge stitch 114, and pocket stitches 116-120. Strap 102 further includes side stitches 122-124 and tapered edge 126. D-ring strap 104 also includes side stitches 128-130 and one or more D-rings 132. Stiffener pocket 134 is also provided, being bounded by pocket stitches 136-138 and upper top edge stitch 106 and lower top edge stitch 108. In some examples, strap 102 may be secured to D-ring strap 104 using a knot or by running strap 102 between D-rings 132, as shown with strap section 302. In some examples, strap 102 may be threaded through D-rings 132, which are secured and taut when tension is applied to either tapered edge 126 or strap 102. Strap 102 may be adjusted in length using D-rings 132 to accommodate a wearer with broad or narrow shoulders, a thick or thin neck, or to compensate for a desired area of coverage provided by nursing cover 300. In other examples, nursing cover 300 may be secured differently and is not limited to the examples shown and described.

When worn, nursing cover 300 provides shade and protection from unwanted observers for a nursing mother and her child. Strap 102, when secured to D-ring strap 104 using D-rings 132, falls or drapes over a nursing child underneath. A stiffener in stiffener pocket 134 extends nursing cover 300 away from the neck and upper torso of the mother and provides a pocket in which the baby rests and remains visible to the mother. Further, a mother may also wear nursing cover 300 as a sunshade to protect a baby underneath, who may be carried in the mother's arms while nursing, cradled in a sling (e.g., Baby Bjorn®), or otherwise held in a position that may warrant protection from observation, sun, weather, wind, or other environmental factors that may affect the baby.

Figure 4A:
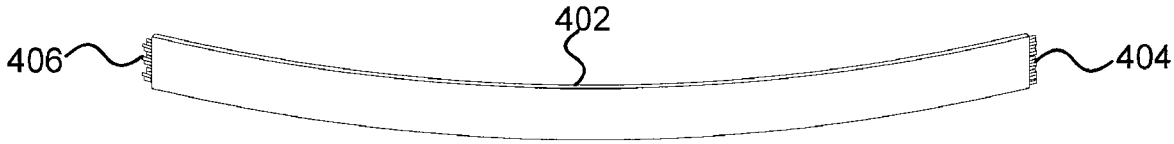
FIG. 4A illustrates an exemplary stiffener.

FIG. 4A illustrates an exemplary stiffener. Here, stiffener 402 is shown with edges 404-406. In some examples, stiffener 402 may be formed using natural materials such as wood, bamboo, and others. In other examples, stiffener 402 may be formed using synthetic materials such as plastic, nylon, steel, metal, composites (e.g., Teflon®, Kevlar®, and others). Materials used for stiffener 402 may be durable, light, waterproof or water-resistant, and formed to prevent moisture accumulation or mildew when placed within stiffener pocket 134 (FIGS. 1, 2A-2B, 3). Stiffener 402 may be formed from any material that, when placed within pocket 134, provides a bent or semi-hemispherical shape that is used to bow the upper edge of nursing cover 100 (FIGS. 1, 2A-2B, 3) outward from the wearer. In some examples the degree of bend (i.e., radius of curvature) may be adjusted or customized for different wearers, depending upon the amount of visibility desired. In other words, if a larger area of visibility is desired, stiffener 402 may be formed using a greater length and radius of curvature. When formed, stiffener 402 retains a bent or curved shape when in a resting position. Further, when force is applied to bend or curve stiffener 402 in the opposite direction of a formed curve, stiffener 402 may be formed of materials that allow bending without breaking. Here, edges 404-406 may expose individual fibers or strands of material within stiffener 402. When placed in contact with sheet 101 (i.e., when placed within pocket 134), edges 404-406 may abrade against the fabric of sheet 101, resulting in tears or cuts in sheet 101, as well as causing stiffener 402 to slip out of place. By placing end caps (as described below in greater detail in connection with FIGS. 4B-4C) on stiffener 402, abrasion and cutting may be prevented or minimized, resulting in the continuing ability of nursing cover 100 to bend outward along its upper edge away from the wearer. In other examples, stiffener 402 may be formed of different materials with different properties and material characteristics other than those described above.

Figure 4B:
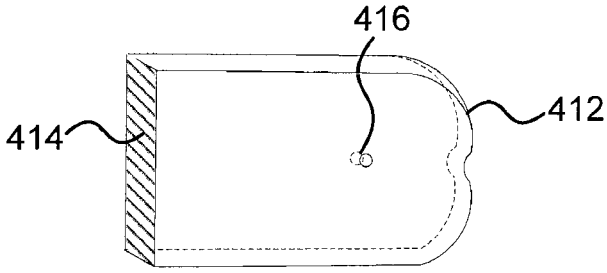
FIG. 4B illustrates an exemplary end cap.

FIG. 4B illustrates an exemplary end cap. Here, end cap 412 is shown with opening 414 and port 416. In some examples, stiffener 402 (FIG. 4A) may be placed into opening 414 and inserted until contact is made with the inside surface of the opposing side of end cap 412. End cap 412 may be positioned over edges 404-406, providing a non-abrading, substantially smooth surface that, when placed within pocket 134 (FIG. 1) of nursing cover 100, prevents tears or cuts in sheet 101. Further, end cap 412 may be used to also prevent edges 404-406 from tearing or cutting through pocket 134 and pressing into exposed skin surfaces of the wearer, which may cause pain, injury, or both. Further, end cap 412 may also provide protection to a baby protected underneath by preventing rough edges of stiffener 402 from pressing into the skin, eyes, or extremities of a child. Port 416 provides a window or aperture for viewing within end cap 412. Port 416 may be used to determine whether stiffener 402 has been fully or partially inserted into end cap 412. In some examples, port 416 may also be used to relieve overpressure within end cap 412 if the outer edges of stiffener 402 provide a seal by contacting the inner surfaces of opening 414. In some examples, the shape of end cap 412 is formed to provide smooth, rounded surfaces to prevent abrading, tearing, or cutting into sheet 101. In other examples, different shapes and sizes may be used for end cap 412 and are not limited to the examples shown above. For example, a rounded or hemispherical shape may be used for end cap 412. In other examples, a square or substantially rectangular shape may be used for end cap 412, providing a secure and substantially smooth surface that does not catch, abrade, tear, or cut the inner lining or surface of pocket 134. End cap 412 may be implemented differently in design, shape, and dimension. Other examples may be used and are not limited to the examples shown and described.

Figure 4C:
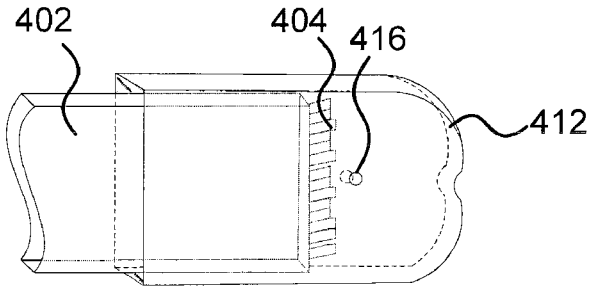
FIG. 4C illustrates an exemplary stiffener and end cap.

FIG. 4C illustrates an exemplary stiffener and end cap. Here, a cross sectional area of stiffener 402 is shown and end cap 412 is placed over edges 404. In some examples, end cap 412 may be placed over edges 404 to protect fabric (i.e., sheet 101 (FIG. 1)) from abrasion, tears, or cuts that may be caused by the rough surfaces of stiffener 402 and edges 404. Edges 404 may be created when stiffener 402 is cut from an overall longer length of material. Here, stiffener 402 may be inserted into end cap 412 and fully positioned when edges 404 are seen within port 416. In some examples, edges 404 may be fully inserted into end cap 412, which provides a smooth end surface that does not abrade, cut, or tear the fabric of sheet 101 and pocket 134. In other examples, edges 404 may be partially inserted into end cap 412 and the extent of insertion may be controlled by viewing how far stiffener 402 has advanced into end cap 412 using port 416. In other examples, end cap 412 may be formed as part of stiffener 402, thus omitting edges 404 and providing a smooth, integrated surface that prevents abrasion, tearing, or cutting of sheet 101. In still other examples, end cap 412 may be inserted over or onto stiffener 402 differently and is not limited to the examples shown and described.

In some examples, end cap 412 and stiffener 402 may be formed, connected, glued, sewn, stitched, or otherwise coupled (i.e., directly or indirectly) together. For example, end cap 412 and stiffener 402 may be sewn together by using thread, string, or other synthetic or natural fibers to secure end cap 412 to stiffener 402. Synthetic or natural fibers (not shown) may be threaded through port 416 on a side of end cap 412, through the material of stiffener 402, and out through another port located on an opposing side of end cap 412. Synthetic, natural, or other connective materials used to couple end cap 412 to stiffener 402, may be comprised of any type of synthetic or natural material to provide a memory shape such as that described above. As another example, end cap 412 may be coupled to stiffener 402, but melted together by applying heat, solvents, or other materials that may result in the fusion, materially or molecularly, of end cap 412 with stiffener 402. Likewise, various types of glues and adhesive materials may also be applied to couple end cap 412 to stiffener 402. Further, stiffener 402 may be formed with end cap 412 disposed at both ends. In other words, end cap 412 may be formed as part of stiffener 402 using the same or different material. As yet another example, different a connector may be used to couple end cap 412 to stiffener 402.

In some examples, a connector may be a "plug," "bar," or rail comprised of any type of natural or synthetic fiber that may be pressed through end cap 412 and stiffener 402 to secure both end cap 412 and stiffener 402 together. A connector may also be any type of intermediary material used to mechanically or structurally couple end cap 412 to stiffener 402. Stiffener 402 and end caps 412 may be formed as a single, monolithic piece or by using multiple, different pieces coupled using techniques such as those described above. Further, any type of technique for coupling stiffener 402 and end caps 412 may be used and are not limited to the examples provided above. Other types and techniques for securing end cap 412 to stiffener 402 may be used and are not limited to the above-described examples.

Although the foregoing examples have been described in detail for purposes of clarity of understanding, certain changes and modifications may be practiced within the scope of the appended claims. Accordingly, the present examples are to be considered as illustrative and not restrictive, and not limited to the details given herein and may be modified within the scope and equivalents of the appended claims. In the claims, elements and/or steps do not imply any particular order of operation, unless explicitly stated in the claims.

What is claimed is:

1. A nursing cover, comprising:

a sheet having a top edge, a bottom edge, a first side edge and a second side edge, wherein a stiffener pocket, a first strap and a second strap are disposed along the top edge of the sheet, the first strap and the second strap being configured to detachably couple together; and a stiffener housed within the stiffener pocket and being configured to bow outward from the top edge of the sheet, the stiffener comprised of a shape memory material comprising a material memory associated with a pre-determined shape, the stiffener assuming the pre-determined shape during a resting state and, when a force is applied, the stiffener is configured to temporarily deform and, when the force is removed, the stiffener reassumes the pre-determined shape, the stiffener having a first end cap formed at a first end and a second end cap formed at a second end, wherein the stiffener, the first end cap and the second end cap collectively comprise a single member.

2. The nursing cover of claim 1, wherein the stiffener, the first end cap and the second end cap are each comprised of a natural material.

3. The nursing cover of claim 1, wherein the stiffener, the first end cap and the second end cap are each comprised of a synthetic material.

4. The nursing cover of claim 1, wherein the first end cap and the second end cap are substantially round.

5. The nursing cover of claim 1, wherein the first end cap and the second end cap comprise a rectangular cross-section.

6. The nursing cover of claim 1, wherein the first end cap and the second end cap comprise a substantially smooth outer surface.

7. A nursing cover, comprising:

a sheet having a top edge, a bottom edge, a first side edge and a second side edge, wherein a stiffener pocket, a first strap and a second strap are disposed along the top edge of the sheet, the first strap and the second strap being configured to detachably couple together; and a stiffener having a first end and a second end, the stiffener being enclosed within the stiffener pocket, and each of the first end and the second end being configured to minimize abrasion between the stiffener and an interior surface of the stiffener pocket, the stiffener being configured to bow outward from the top edge of the sheet and comprised of a shape memory material comprising a material memory associated with a pre-determined shape, the stiffener assuming the pre-determined shape during a resting state and, when a force is applied, the stiffener being configured to temporarily deform and, when the force is removed, the stiffener reassuming the pre-determined shape.

8. The nursing cover of claim 7, wherein the stiffener is comprised of a natural material.

9. The nursing cover of claim 7, wherein the stiffener is comprised of a synthetic material.

10. The nursing cover of claim 7, wherein the first end and the second end are substantially round.

11. The nursing cover of claim 7, wherein the first end and the second end each comprise a rectangular cross-section.

12. The nursing cover of claim 7, wherein the first end and the second end each comprise a substantially smooth outer surface.

13. A nursing cover, comprising:

a sheet having a top edge, a bottom edge, a first side edge and a second side edge, wherein a stiffener pocket, a first strap and a second strap are disposed along the top edge of the sheet, the first strap and the second strap being configured to detachably couple together; and a stiffener, a first end cap, and a second end cap being formed as a monolithic piece, the first end cap forming a first end and the second end cap forming a second end, the first end and the second end each comprising a non-abrading outer surface, the stiffener being housed within the stiffener pocket and configured to bow outward from the top edge of the sheet, the stiffener comprised of a shape memory material comprising a material memory associated with a pre-determined shape, the stiffener assuming the pre-determined shape during a resting state and, when a force is applied, the stiffener is configured to temporarily deform and, when the force is removed, the stiffener reassumes the pre-determined shape.

14. The nursing cover of claim 13, wherein the stiffener is comprised of a natural material.

15. The nursing cover of claim 13, wherein the stiffener is comprised of a synthetic material.

16. The nursing cover of claim 13, wherein the first edge and the second edge are substantially round.

17. The nursing cover of claim 13, wherein the first edge and the second edge have a rectangular cross-section.

* * * * *

UNITED STATES PATENT AND TRADEMARK OFFICE

CERTIFICATE OF CORRECTION

PATENT NO. : 7,805,771 B2
APPLICATION NO. : 12/143140
DATED : October 5, 2010
INVENTOR(S) : Ronnie Michael Ekelund and Claire Rachael Jane Ekelund It is certified that error appears in the above-identified patent and that said Letters Patent is hereby corrected as shown below:

Column 8, lines 49-52, for the claim reference to "edge", each occurrence, should be changed to --end--.

Signed and Sealed this
Twenty-sixth Day of July, 2011

David J. Kappos

David J. Kappos
*Director of the United States Patent and Trademark Office*